US007987990B2

(12) United States Patent
Srivatsan

(10) Patent No.: US 7,987,990 B2
(45) Date of Patent: Aug. 2, 2011

(54) SYSTEM, METHODOLOGY, AND PRODUCT TO SORT, ORGANIZE, AND STORE TOY BUILDING/CONSTRUCTION SETS

(76) Inventor: Akshay Srivatsan, Palo Alto, CA (US)

( * ) Notice: Subject to any disclaimer, the term of this patent is extended or adjusted under 35 U.S.C. 154(b) by 78 days.

(21) Appl. No.: 12/416,861

(22) Filed: Apr. 1, 2009

(65) Prior Publication Data

US 2009/0261022 A1 Oct. 22, 2009

Related U.S. Application Data

(60) Provisional application No. 61/046,743, filed on Apr. 21, 2008.

(51) Int. Cl.
*B07B 1/04* (2006.01)
*B07B 1/28* (2006.01)
*B07B 1/34* (2006.01)

(52) U.S. Cl. ..... 209/355; 209/315; 209/325; 209/352; 209/353; 209/354

(58) Field of Classification Search ..... 209/309, 209/315, 325, 352, 353, 354, 355
See application file for complete search history.

(56) References Cited

U.S. PATENT DOCUMENTS

| | | | | | |
|---|---|---|---|---|---|
| 173,782 | A * | 2/1876 | Graves | 209/275 |
| 1,027,734 | A * | 5/1912 | Hunnicut | 209/355 |
| 1,085,516 | A * | 1/1914 | Wilson et al. | 209/355 |
| 1,714,208 | A * | 5/1929 | Boix | 209/370 |
| 2,692,044 | A * | 10/1954 | Chappell | 209/355 |
| 3,315,807 | A * | 4/1967 | Rosen | 209/315 |
| 3,367,498 | A * | 2/1968 | Tonjes et al. | 209/319 |
| 5,749,317 | A * | 5/1998 | Richey et al. | 119/166 |
| 2007/0158244 | A1 * | 7/2007 | Puda et al. | 209/309 |

* cited by examiner

*Primary Examiner* — Stefanos Karmis
*Assistant Examiner* — Brett C Martin

(57) ABSTRACT

A system, methodology, and product to sort, organize and store individual members of building/construction toy sets utilizing a multi-level system of bins with sieves at different heights using user applied forces and gravity to automatically sort and organize pieces into bins, while providing a fun hands-on sorting experience for kids. The location, size and shape of the sieves can be designed to optimize sorting speed and user experience for specific toy manufacturer brands including Lego™ bricks made by Lego Corporation. The system also functions as a storage unit for the pieces, during and after sort. A flexible binding mechanism holds the system together during sort. The system is designed with see-through materials to monitor the status of the sort and find specific pieces in respective bins. A set of wheels enables mobility. The "hands-on" involvement in sorting also makes this an entertaining and educational apparatus for kids.

2 Claims, 3 Drawing Sheets

SYSTEM, METHODOLOGY, AND PRODUCT TO SORT, ORGANIZE, AND STORE TOY BUILDING/CONSTRUCTION SETS

CROSS-REFERENCE TO RELATED APPLICATIONS

This application claims priority from U.S. Provisional Patent Application Ser. No. 61/046,743 entitled SYSTEM, METHODOLOGY, AND PRODUCT TO SORT, ORGANIZE, AND STORE TOY BUILDING/CONSTRUCTION SETS filed on Apr. 21, 2008 which is hereby incorporated by reference as if set forth in full in this application for all purposes.

BACKGROUND OF THE INVENTION

The present invention relates generally to a system, a methodology, and a product to sort, organize and store toy building/construction sets comprising a plurality of building members of different shapes, weights, sizes. More particularly, this invention can be applied to sorting, organizing and storing of the individual members of construction toys. Such toys are very popular in the marketplace and sold under brand names including Lego, K-nex, Tyco and others. We will refer to such toys as Lego toys or construction toys or building toys or building/construction toys in the rest of the document.

Kids (and several adults) like playing and building structures using Lego blocks, bricks and pieces. Building with Lego blocks is fun for kids. Kids, as they grow, like to build more complex structures that require a large number of pieces spanning multitudes of shapes, sizes and weights and their Lego collection expands. As the structures become more complex and the collections become large, it becomes more difficult for kids to find the right pieces of required sizes, shapes or weights for their next build. This results in a more messy playing environment and more time spent in sorting or finding individual pieces for their next build vs. using the time to actually "build" their next construction set.

As such, what is needed is an efficient system, methodology and a product that enables kids to sort, organize and store the individual Lego pieces spanning a wide variety of sizes, shapes and weights in a way that significantly reduces the time it requires for them to find the pieces for their next build and enables them to organize and store the pieces between builds.

SUMMARY OF THE INVENTION

This invention discloses a system, methodology, and product to sort, organize and store individual pieces of building/construction sets utilizing a multi-level system of bins with sieves at different heights. The system utilizes a combination of gravitational force on the individual pieces and manual forces applied by the user on the system to automatically sort and organize pieces in to the respective bins. The location, size and shape of the sieves in each bin can be chosen to optimize for sorting speed and user experience for specific brands including Lego, K-nex and Tyco. Each bin and its system of sieves is designed and constructed in a way that allows for specific sizes, shapes and weights to filter through to the next level, resulting finally in a set of sorted pieces at different levels. In addition, the size of the individual bins is selected so the system also functions as a storage unit for the pieces, during and after the sort. A flexible binding mechanism (such as one using Velcro and tape) holds the system together during sort while allowing kids to have hands on fun and experience the sorting process. The system is designed with see-through, semi-transparent or transparent, lightweight materials to monitor the status of the sort, look for specific pieces in the respective bins. A set of wheels enables mobility of the unit. The hands-on experience that kids get in sorting through shaking/rolling/swaying and finding their required pieces also makes this system a uniquely entertaining and educational apparatus for kids.

The construction and method of operation of the invention, however, together with additional objectives and advantages thereof will be best understood from the following description of specific embodiments when read in connection with the accompanying drawings.

DESCRIPTION OF THE INVENTION

The invention claimed here enables kids and adults to rapidly sort, find, organize, store, and access individual members of a broad family of toys that enable construction of different shapes and sizes using individual members as building blocks. The methodology, methods and product described here pertain to an integrated modular system with sort, store, organize and access capabilities across multitude of individual members of different shapes, sizes and weights through a system of multi-level bins, each with a unique number, size and location of holes that allow for combining the natural force of gravity with user applied forces to allow each user to tailor their own experience. The integrated design includes mechanisms for safe operation and transport of the integrated mechanism.

Figure 1A:
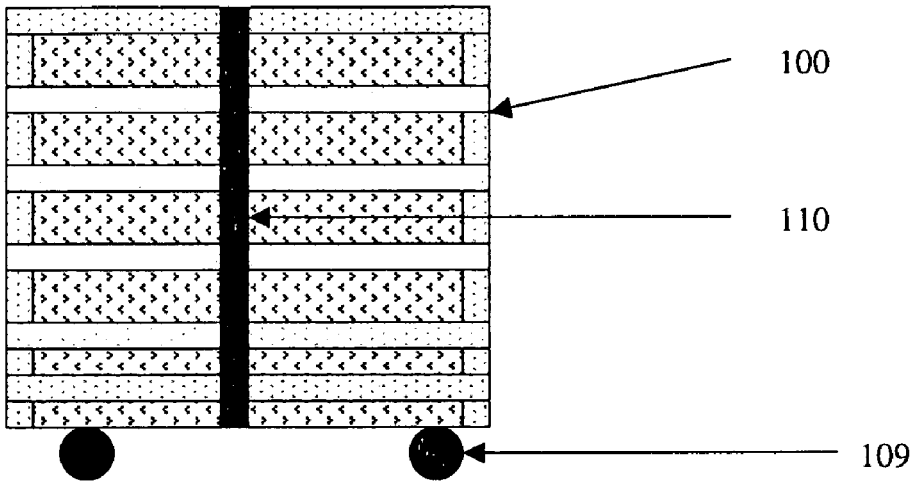
FIG. 1A-1C schematically illustrate the front view, top view and side-view of the apparatus utilizing the methodology and a specific method for sorting, organizing and storing pieces in the construction toys from Lego in accordance with one embodiment of the present invention.

FIG. 1A illustrates a schematic of the front view of the prototype product LEG-O-RGANIZER 100 designed utilizing the methodology and a specific method for sorting, organizing and storing pieces in the construction toys from Lego in accordance with one embodiment of the present invention.

Figure 1B:
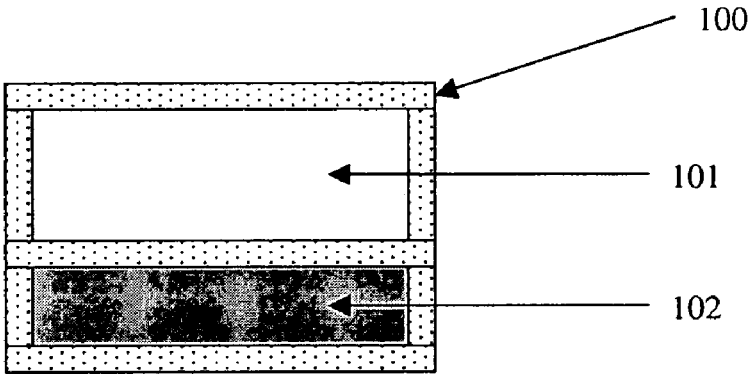

FIG. 1B illustrates the top view of schematic of the prototype product LEG-O-RGANIZER 100 designed utilizing the methodology and a specific method for sorting, organizing and storing pieces in the construction toys from Lego in accordance with one embodiment of the present invention.

Figure 1C:
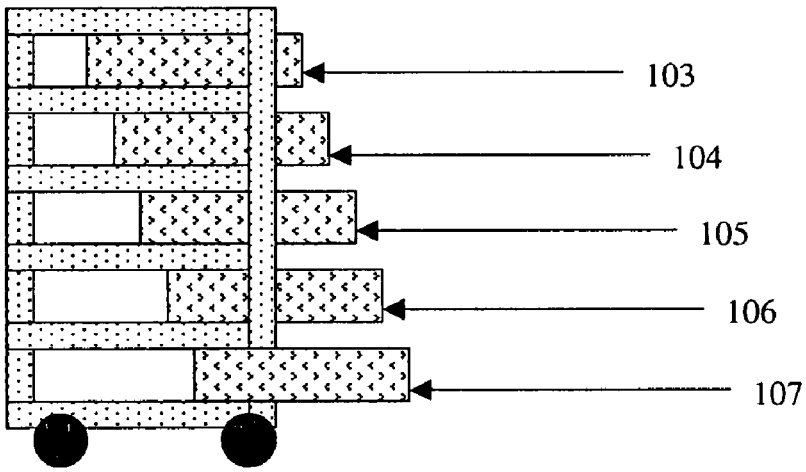

FIG. 1C illustrates the side view of the schematic of the prototype product LEG-O-RGANIZER 100 designed utilizing the methodology and a specific method for sorting, organizing and storing pieces in the construction toys from Lego in accordance with one embodiment of the present invention.

LEG-O-RGANIZER 100 comprises of a five-level bin system made of a lightweight see-through material and mounted on 4 wheels. Each of the five individual bins can be independently pulled out or pushed in. The top surface of the LEG-O-RGANIZER 100 is flat and made of a sturdy material. There is a large opening 101 on the top surface to introduce multiple new members simultaneously into the sorting system. There is a flat surface 102 which can be used to display and hold assembled construction toys. The system of stackable bins 103-107 are made of lightweight transparent material to hold and store sorted individual members. Additional bins can be added to expand the unit. Each bin has a set of round sieves as shown in FIG. 2A-2D. The size of the sieves is selected to allow only certain sizes to pass through while retaining larger sizes in the bin. The sort is done through a manual force of rolling, shaking or twisting the unit, which forces pieces in each bin to move towards the sieves and cause certain pieces to fall through sieves enabling the sort. As the system undergoes more shakes, rolls and twists, more pieces get sorted until eventually all pieces are sorted into the right bins. The smallest pieces fall into the lowest bin, the largest are retained in the highest bin and other bins contain pieces of specific size ranges depending on the size of the sieves. Each bin is detachable and can be pulled out like a drawer or completely taken out of the unit and thus allows the user to store the sorter pieces within the sorter system or in the bin that can then be placed elsewhere. The system is mounted on wheels 109 that allow it to be wheeled away and stored at a convenient place. A detachable binding tape 110 holds the bins in place during sort and can be detached once the sort is completed. In the prototype of LEG-O-RGANIZER 100, a Velcro tape functioned as a detachable binding tape.

FIG. 2A-2D schematically illustrates the design of holes in individual sieves for sorting, organizing and storing pieces in the construction toys from Lego in accordance with another embodiment of the present invention.

Figure 2A:
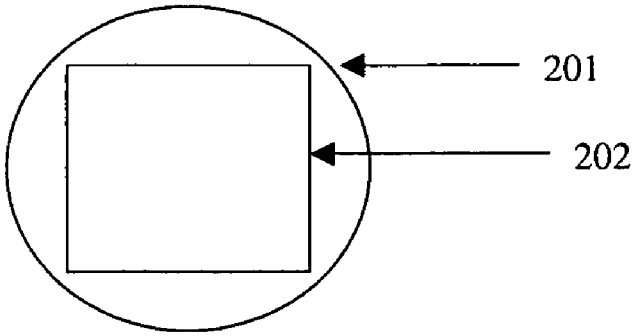
FIG. 2A-2D schematically illustrates the design of holes in individual sieves for sorting, organizing and storing pieces in the construction toys from Lego in accordance with another embodiment of the present invention.

FIG. 2A shows the design of hole 201 in sieve for a 4*4 Lego brick 202 to filter through to next level. In addition to 4*4 brick, the holes let 1*1, 1*2, 1*3, 1*4, 2*1, 2*2, 2*3, 2*4, 3*1, 3*2, 3*3, 3*4, 4*1, 4*2, 4*3 bricks and any Lego brick smaller than a 4*4 brick also to filter through.

Figure 2B:
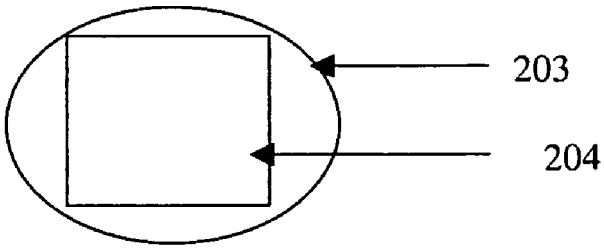

FIG. 2B shows the design of hole 203 in sieve for a 3*3 Lego brick 204 to filter through to next level. In addition to 3*3 brick, the holes let 1*1, 1*2, 1*3, 2*1, 2*2, 2*3, 3*1, 3*2 bricks and any Lego brick smaller than a 3*3 brick also to filter through.

Figure 2C:
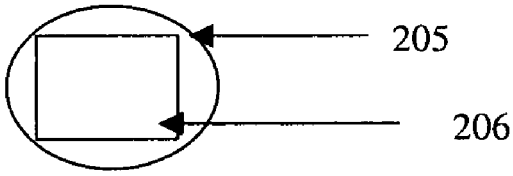

FIG. 2C shows the design of hole 205 in sieve for a 2*2 Lego brick 206 to filter through to next level. In addition to 2*2 brick, the holes let 1*1, 1*2 bricks and any Lego brick smaller than a 2*2 brick also to filter through.

Figure 2D:
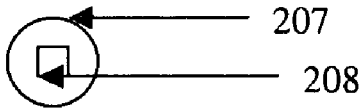

FIG. 2D shows the design of holes 207 in sieve for a 1*1 Lego brick 208 to filter through to next level.

FIG. 3A-3D schematically illustrates the design of individual sieves for sorting, organizing and storing pieces in the construction toys from Lego in accordance with yet another embodiment of the present invention.

Figure 3A:
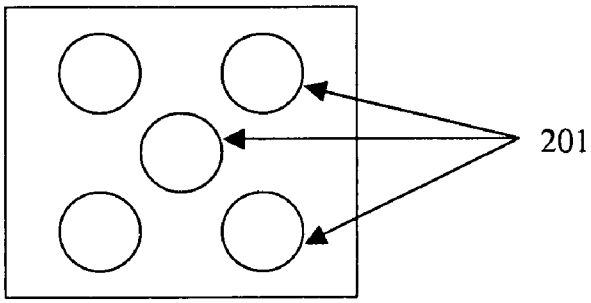
FIG. 3A-3D schematically illustrates the design of individual sieves for sorting, organizing and storing pieces in the construction toys from Lego in accordance with yet another embodiment of the present invention.

FIG. 3A shows the design of sieve with holes for topmost bin as shown in FIG. 2A. The holes let 1*1, 1*2, 1*3, 1*4, 2*1, 2*2, 2*3, 2*4, 3*1, 3*2, 3*3, 3*4, 4*1, 4*2, 4*3, 4*4 bricks and any Lego brick smaller than a 4*4 brick also to filter through to lower level. The Lego bricks bigger that the 4*4 brick are collected and stored in the topmost bin.

Figure 3B:
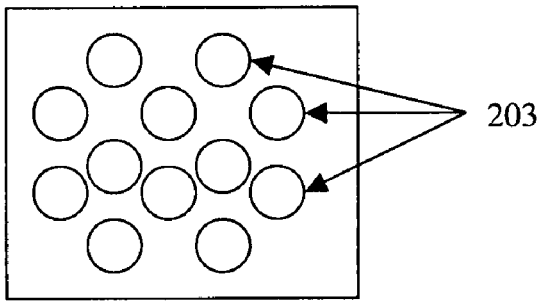

FIG. 3B shows the design of sieve with holes as shown in FIG. 2B. The holes let 1*1, 1*2, 1*3, 2*1, 2*2, 2*3, 3*1, 3*2, 3*3 bricks and any Lego brick smaller than a 3*3 brick also to filter through to lower level. The Lego bricks 4*1, 4*2, 4*3 and 4*4 are collected and stored in this bin.

Figure 3C:
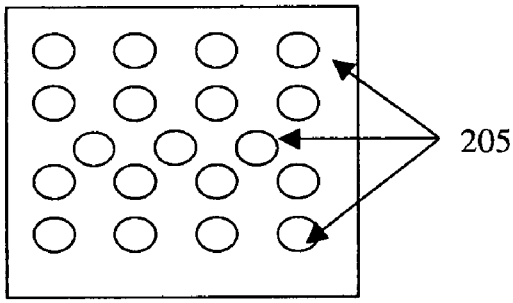

FIG. 3C shows the design of sieve with holes as shown in FIG. 2C. The holes let 1*1, 1*2, 2*1, 2*2 bricks and any Lego brick smaller than a 2*2 brick also to filter through to lower level. The Lego bricks 3*1, 3*2, and 3*3 are collected and stored in this bin.

Figure 3D:
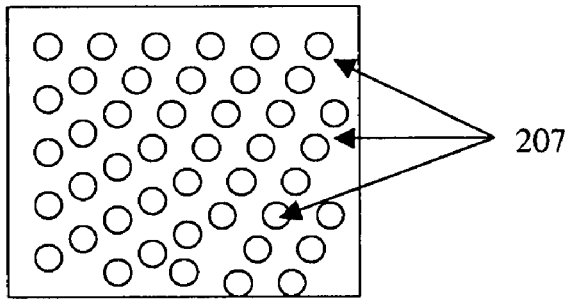

FIG. 3D shows the design of sieve with holes as shown in FIG. 2D. The holes let 1*1 bricks and any Lego brick smaller than a 1*1 brick also to filter through to lower level. The Lego bricks 2*1, and 2*2 are collected and stored in this bin.

The 1*1 Lego bricks filter through and are collected and stored in the lowermost bin.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A method for sorting construction toys comprising building blocks having a plurality of predetermined shapes and sizes, comprising:

providing a sorting device, comprising:

an opening at a top of said device provided to allow for blocks to be introduced into said device;

a plurality of superposed, removable sorting bins, wherein each bin defines a plurality of rounded or circular sorting openings in a bottom portion of said bin;

the sorting openings in each of the plurality of bins being sized such that for an individual bin, certain building blocks of a predetermined size are allowed to pass through said openings while a remainder of said blocks are retained in said bin;

a bottom-most bin having no openings in a bottom of said bin so as to collect building blocks that pass through the sorting openings in each bin above;

a top-most bin of said plurality of sorting bins contains openings in the bottom of said bin configured to allow blocks having sizes 4×4 or smaller to filter through said openings to a first intermediate bin;

the first intermediate bin, of said plurality of sorting bins contains openings in the bottom of said bin configured to allow blocks having sizes 3×3 or smaller to filter through said openings to a second intermediate bin;

the second intermediate bin of said plurality of sorting bins contains openings in the bottom of said bin configured to allow blocks having sizes 2×2 or smaller to filter through said openings to a third intermediate bin;

the third intermediate bin of said plurality of sorting bins contains openings in the bottom of said bin configured to allow blocks having sizes 1×1 or smaller to filter through said openings to the bottom-most bin;

a plurality of releasable binding mechanisms, at least one for each bin, configured to hold each of the bins in place during the sorting;

a plurality of casters mounted on a bottom of said apparatus to allow for said apparatus to roll;

providing a mixture of unsorted building blocks having a plurality of shapes and sizes;

introducing the mixture of unsorted building blocks into the top opening of the sorting device;

holding the remaining bins in place by way of the binding mechanism whereby the bins do not move independent of each other;

applying forces to the sorting device to move pieces in each bin towards respective openings in the bins;

whereby the building blocks are sorted into appropriate bins according to size and shape as determined by the openings in each bin.

2. A method to do a fast sort for a desired size or shape of construction toys comprising building blocks having a plurality of predetermined sizes and shapes using a sorting apparatus comprising:

providing a sorting device, comprising:

an opening at a top of said apparatus provided to allow for blocks to be introduced into said apparatus;

a plurality of superposed, removable sorting bins, wherein each bin defines a plurality of rounded or circular sorting openings in a bottom portion of said bin;

the sorting openings in each of the plurality of bins being sized such that for an individual bin, certain building blocks of a predetermined size are allowed to pass through said openings while a remainder of said blocks are retained in said bin;

a bottom-most bin having no openings in a bottom of said bin so as to collect building blocks that pass through the sorting openings in each bin above;

a top-most bin of said plurality of sorting bins contains openings in the bottom of said bin configured to allow blocks having sizes 4×4 or smaller to filter through said openings to a first intermediate bin;

the first intermediate bin, of said plurality of sorting bins contains openings in the bottom of said bin configured to allow blocks having sizes 3×3 or smaller to filter through said openings to a second intermediate bin;

the second intermediate bin of said plurality of sorting bins contains openings in the bottom of said bin configured to allow blocks having sizes 2×2 or smaller to filter through said openings to a third intermediate bin;

the third intermediate bin of said plurality of sorting bins contains openings in the bottom of said bin configured to allow blocks having sizes 1×1 or smaller to filter through said openings to the bottom-most bin;

a plurality of releasable binding mechanisms, at least one for each bin, configured to hold each of the bins in place during the sorting;

a plurality of casters mounted on a bottom of said apparatus to allow for said apparatus to roll;

removing all bins above a bin where the desired size or shape of building block is collected;

feeding in building blocks comprising one or more sizes and shapes through the opening at the top of the apparatus;

holding the remaining bins in place by way of the binding mechanism whereby the bins do not move independent of each other;

rolling the bin assembly to apply a shaking force to the apparatus, whereby the pieces in each bin move laterally towards the openings in that bin;

repeating the rolling step until all blocks are sorted or the blocks of the desired shape or size are collected;

removing the binding mechanism whereby one or more bins can be independently accessed; and removing one or more bins with building blocks of the desired sizes.

* * * * *